US007760045B2

(12) United States Patent
Kawasaki

(10) Patent No.: US 7,760,045 B2
(45) Date of Patent: Jul. 20, 2010

(54) SEMICONDUCTOR DEVICE INTERCONNECTING UNIT, SEMICONDUCTOR DEVICE, HIGH-FREQUENCY MODULE, AND SEMICONDUCTOR DEVICE INTERCONNECTING METHOD

(75) Inventor: Kenichi Kawasaki, Tokyo (JP)

(73) Assignee: Sony Corporation, Tokyo (JP)

( * ) Notice: Subject to any disclaimer, the term of this patent is extended or adjusted under 35 U.S.C. 154(b) by 13 days.

(21) Appl. No.: 11/745,886

(22) Filed: May 8, 2007

(65) Prior Publication Data

US 2007/0268094 A1 Nov. 22, 2007

(30) Foreign Application Priority Data

May 19, 2006 (JP) ..... P2006-140593

(51) Int. Cl.
*H01P 5/04* (2006.01)

(52) U.S. Cl. ..... 333/24 R; 333/175

(58) Field of Classification Search ..... 333/185, 333/175, 186, 181, 12, 183, 184, 204, 174, 333/24 R, 103, 32; 455/333, 326, 307; 342/322; 257/754

See application file for complete search history.

(56) References Cited

U.S. PATENT DOCUMENTS 5,057,778 A * 10/1991 Rath ..... 324/322
5,166,621 A * 11/1992 Codrington et al. ..... 324/322
5,180,999 A * 1/1993 Edwards ..... 333/175
5,202,656 A * 4/1993 Clark et al. ..... 333/174
5,697,087 A * 12/1997 Miya et al. ..... 455/307
6,356,162 B1 * 3/2002 DeFlandre et al. ..... 333/4
6,646,520 B2 * 11/2003 Miller ..... 333/32
7,327,035 B2 * 2/2008 Barton et al. ..... 257/754
7,418,251 B2 * 8/2008 Liu ..... 455/333
2002/0135439 A1 * 9/2002 Chueh et al. ..... 333/175
2003/0209784 A1 11/2003 Schmitz et al.
2005/0245102 A1 11/2005 Cave et al.

FOREIGN PATENT DOCUMENTS

JP 10-190307 7/1998
JP 11-274369 10/1999
JP 2003-283286 10/2003
JP 2005-524995 A 8/2005
JP 2006-74257 3/2006
JP 2007-31221 11/2007

OTHER PUBLICATIONS

Japanese Office Action issued on Oct. 6, 2009, for corresponding Application No. JP 2006-140593.

* cited by examiner

*Primary Examiner*—Vibol Tan
*Assistant Examiner*—Crystal L Hammond
(74) *Attorney, Agent, or Firm*—K&L Gates LLP

(57) ABSTRACT

A semiconductor device interconnecting unit for inputting/outputting a high-frequency signal having a millimeter wave band to/from a semiconductor device includes a part of a band pass filter and a remainder is provided. The part of a band pass filter is configured to pass therethrough the high-frequency signal having a millimeter wave band by using an LC resonance circuit. The part and the remainder are separated from each other by a capacitive portion, the part is provided inside the semiconductor device, and the remainder is provided outside the semiconductor device.

5 Claims, 10 Drawing Sheets

SEMICONDUCTOR DEVICE INTERCONNECTING UNIT, SEMICONDUCTOR DEVICE, HIGH-FREQUENCY MODULE, AND SEMICONDUCTOR DEVICE INTERCONNECTING METHOD

CROSS REFERENCE TO RELATED APPLICATIONS

The present application claims priority to Japanese Patent Application JP 2006-140593 filed in the Japanese Patent Office on May 19, 2006, the entire contents of which is being incorporated herein by reference.

BACKGROUND

The present application relates to a semiconductor device interconnecting unit for inputting/outputting a high-frequency signal to/from a semiconductor device, and a semiconductor device interconnecting method. Also, the application relates to semiconductor devices which are interconnected to each other by the semiconductor device interconnecting unit. Also, the present application relates to a high-frequency module in which semiconductor devices interconnected to each other by the semiconductor device interconnecting unit and semiconductor device interconnecting method are installed together with other elements or devices.

Japanese Patent Laid-open No. 2006-74257 discloses a high-frequency band pass filter, and a cable connector unit with a built-in filter. Here, the high-frequency band pass filter filters an interfering wave or the like with which a received broadcasting wave is mixed. Also, the cable connector unit with a built-in filter is structured by using the high-frequency band pass filter and is used in the form of intermediate one which is inserted into a cable of a broadcasting receiver.

Now, in recent years, a digital camera has come to have a resolution corresponding to five millions or more pixels with the advance of the technology relating to an image pickup device using a CCD, a CMOS and the like. An increase in precision of an image increases with the improvement in the resolution results in that an amount of image data increases. For this reason, it is necessary to increase a speed of a data communication between the image pickup device and a signal processing circuit for subjecting an image signal corresponding to an image captured with the image pickup device to image signal processing. In addition, in a liquid crystal TV as well, a high speed promotion for a data communication has similarly become a problem.

For the high speed promotion for the data communication, for example, the transmission of a high-frequency signal having a frequency band, of 10 to 100 GHz, sufficiently exceeding 1 GHz needs to be taken into consideration. The frequency band of the high-frequency signal belongs to a band called a millimeter wave band, and the high-frequency signal concerned is applied to communication apparatuses, antenna devices, RF sensors and the like.

A bonding technique or a flip flop technique has been utilized in interconnection between semiconductor chips.

However, when the frequency of the transmission signal between the semiconductor chips has been high as in the above-mentioned high-frequency signal having the millimeter wave band, the interconnection between the semiconductor chips becomes difficult due to a dispersion of capacitive components of bonding pads, and a dispersion of lengths of bonding wires. In the case of the flip chip as well, it is not easy to transmit an electromagnetic field energy within one chip to an opposite chip.

Information on a high-frequency signal line contains therein no direct current component in many cases. In such cases, although capacitive interconnection, and interconnection provided from a form of a distributed constant line are expected as candidates, a large capacity is necessary for the capacitive interconnection. In addition, about a quarter wavelength is necessary for the distributed constant line, so that the interconnection is scaled up.

SUMMARY

The present application has been made in the light of the above-mentioned circumstances, and it is therefore desirable to provide a semiconductor device interconnecting unit and a semiconductor device interconnecting method each of which is capable of performing readily interconnection between semiconductor devices even when an input/output signal to/from a semiconductor integrated circuit is a high-frequency signal. In addition, it is desirable to provide a semiconductor device which is interconnected to another one by using the semiconductor device interconnecting unit and method. Also, it is desirable to provide a high-frequency module in which a semiconductor device interconnected to another one by using the semiconductor device interconnecting unit and method is installed together with other elements or devices.

According to an embodiment, there is provided a semiconductor device interconnecting unit for inputting/outputting a high-frequency signal having a millimeter wave band to/from a semiconductor device, including: a part of a band pass filter configured to pass therethrough the high-frequency signal having a millimeter wave band by using an LC resonance circuit; and a remainder of the band pass filter; in which the part and the remainder are separated from each other by a capacitive portion, the part is provided inside the semiconductor device, and the remainder is provided outside the semiconductor device.

According to another embodiment, there is provided a semiconductor device interconnecting unit for interconnecting at least two semiconductor devices to each other, a high-frequency signal having a millimeter wave band being inputted/outputted to/from each of the at least two semiconductor devices, the semiconductor device interconnecting unit including: a first part of a band pass filter configured to pass therethrough the high-frequency signal having a millimeter wave band by using an LC resonance circuit; a second part of the band pass filter; and a third part of the band pass filter; in which the adjacent first and second parts are separated from each other by a capacitive portion provided between the adjacent first and second parts, the adjacent second and third parts are separated from each other by a capacitive portion provided between the adjacent second and third parts, the first part is provided inside a first semiconductor device, the third part is provided inside a second semiconductor device, and the second part has two input/output terminals facing an input/output terminal of the first part, and an input/output terminal of the second part, respectively, and is provided outside each of the first and third semiconductor devices.

According to still another embodiment, there is provided a semiconductor device, a high-frequency signal having a millimeter wave band being inputted/outputted to/from the semiconductor device, the semiconductor device including: a part of a band pass filter configured to pass therethrough the high-frequency signal having a millimeter wave band by using an LC resonance circuit; in which a part of the band pass filter is connected to a remainder of the band pass filter provided in outside by a capacitive portion.

According to yet another embodiment, there is provided a high-frequency module, a semiconductor device to/from which a high-frequency signal having a millimeter wave band is inputted/outputted being installed together with other elements or devices in the high-frequency module, in which the semiconductor device includes a part of a band pass filter for passing therethrough the high-frequency signal having a millimeter wave band by using an LC resonance circuit, and the part of the band pass filter is connected to a remainder of the band pass filter provided in outside the semiconductor device by a capacitive portion.

According to a further embodiment, there is provided a semiconductor device interconnecting method of inputting/outputting a high-frequency signal having a millimeter wave band to/from a semiconductor device, the method including the step of interconnecting a part of a band pass filter for passing therethrough the high-frequency signal having a millimeter wave band by using an LC resonance circuit, and a remainder of the band pass filter separated from the part of the band pass filter by a capacitive portion to each other by the capacitive portion.

In the present application, a circuit is separated into two parts by the portion having a small capacity in the band pass filter. Specially, the part of the circuit structure of the band pass filter is provided inside the semiconductor device, and the portion of the band pass filter which is not included in the semiconductor device is provided in an external adaptor for signal connection. The semiconductor device interconnecting unit according to the embodiment is constituted by the part of the semiconductor device and the external adaptor for signal connection.

In other words, the adaptor for signal connection constituting the semiconductor device interconnecting unit and the semiconductor device are interconnected to each other by the portion having a small capacity in the band pass filter, which results in that the satisfactory signal connection is realized in the form of the small semiconductor connection portion.

Since a direct current component of the high-frequency signal needs not to be necessarily passed, the band pass filter is used in the embodiment.

The band pass filter has the LC resonance circuit, and a circuit portion having a small capacity for the interconnection is provided in the band pass filter. The band pass filter is separated into the two parts by the circuit portion having the small capacity for interconnection. Although the capacity can be reduced to some degree even in the case of a high pass filter (HPF), the reduction of the capacity is more effective in the band pass filter (BPF) structure than in the HPF structure.

More specifically, the band pass filter is separated into the two parts by the portion having the small capacity in the band pass filter. Thus, the part of the band pass filter is provided inside the semiconductor device, and the remainder thereof is provided in the external adaptor for signal connection provided outside the semiconductor device. The portion having the small capacity is used as an interconnection portion between the semiconductor device and the external adaptor for signal connection. There is also such an advantage that an unnecessary signal having a band out of a given band is cut off between the semiconductor chips.

In an embodiment, the present application can also be applied to the interconnection between the semiconductor devices, and thus the side interconnection is made possible. In this case, an energy of an electromagnetic field is caused to smoothly flow.

According to an embodiment, even when the signal inputted/outputted to/from the semiconductor device is a high-frequency signal, the interconnection between the semiconductor device and the external circuit is readily performed.

Additional features and advantages are described herein, and will be apparent from, the following Detailed Description and the figures.

DETAILED DESCRIPTION

The present application will be described in detail hereinafter with reference to the accompanying drawings according to an embodiment. A description will now be given with respect to a semiconductor device interconnecting unit for inputting/outputting a high-frequency signal having a millimeter wave band to/from a semiconductor device according to an embodiment.

Figure 1:
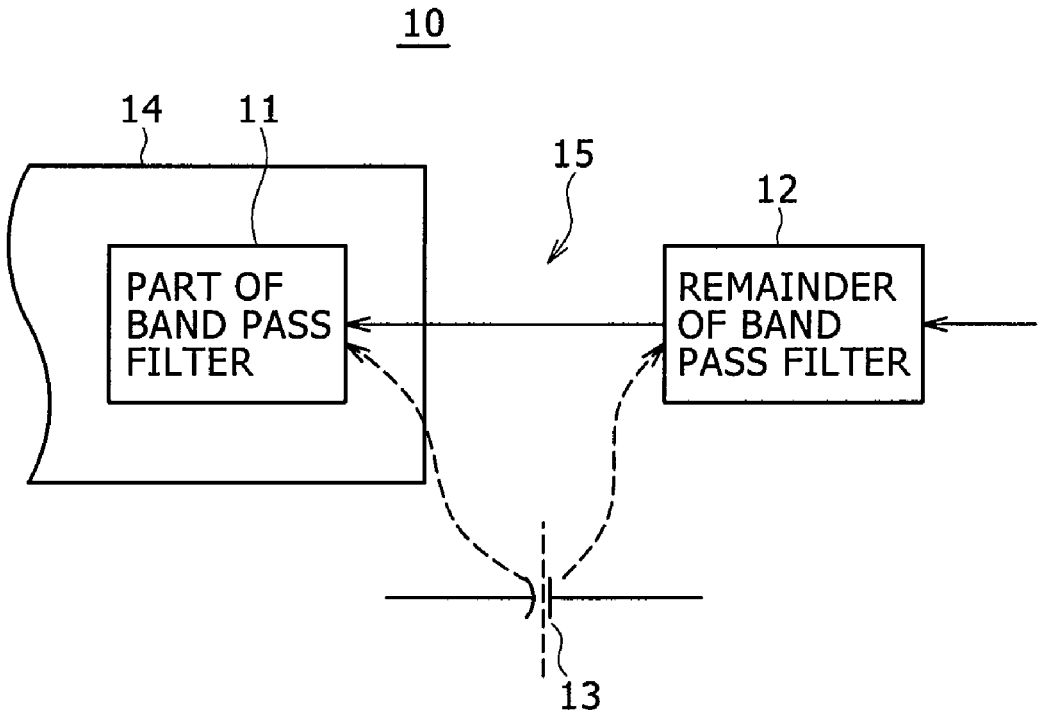
FIG. 1 is a block diagram of a semiconductor device interconnecting unit according to an embodiment.

FIG. 1 is a block diagram showing a schematic constitution of a semiconductor device interconnecting unit 10. The semiconductor device interconnecting unit 10 includes a part 11 of a band pass filter for passing therethrough a high-frequency signal having a millimeter wave band by using an LC resonance circuit, and a remainder 12 of the band pass filter. Here, the part 11 of the band pass filter, and the remainder 12 thereof are separated from each other by a capacitive portion 13. The part 11 of the band pass filter is provided inside a semiconductor device 14, and the remainder 12 thereof is provided in an outside 15 of the semiconductor device 14.

In other words, the semiconductor device 14 is one for receiving as its input/outputting a high-frequency signal having a millimeter wave band, and includes the part 11 of the band pass filter for passing therethrough the high-frequency signal having a millimeter wave band by an LC resonance circuit. Also, the part 11 of the band pass filter is connected to the remainder 12 of the band pass filter provided in the outside 15 by the capacitive portion 13.

In particular, in this embodiment, a circuit is separated into two parts by the portion 13 having a small capacity in the band pass filter having the part 11 and the remainder 12. Thus, the part 11 of the circuit structure of the band pass filter is provided inside the semiconductor device 14, and the remainder 12 of the band pass filter which is not included within the semiconductor device 14 is included in an adaptor for signal connection. Also, the adaptor for signal connection and the semiconductor device 14 are interconnected to each other by the portion 13 having the small capacity in the band pass filter. As a result, the satisfactory signal connection is realized by the small semiconductor connection portion.

Figure 2:
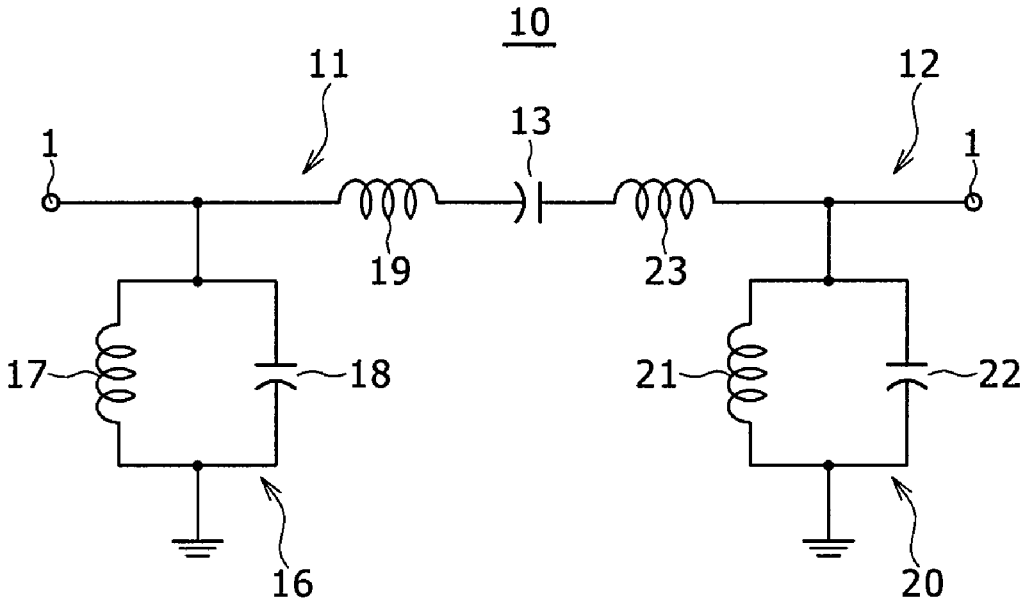
FIG. 2 is a circuit diagram of a main portion of the semiconductor device interconnecting unit shown in FIG. 1.

FIG. 2 is a circuit diagram of a main portion of the semiconductor device interconnecting unit shown in FIG. 1. The part 11 of the band pass filter structure is interconnected to the remainder 12 of the band pass structure through the capacitor 13. An inductor 19 and an inductor 23 are connected to each other so as to hold the capacitor 13 between them. An LC resonance circuit 16 is provided between the inductor 19 and an input/output terminal 1. The LC resonance circuit 16 has an inductor 17 and a capacitor 18 connected in parallel with each other. In addition, an LC resonance circuit 20 is provided between the inductor 23 and an input/output terminal 1. The LC resonance circuit 20 has an inductor 21 and a capacitor 22 connected in parallel with each other.

For example, a semiconductor device which manages a high-frequency signal having a millimeter wave band, for example, containing 60 GHz needs not to necessarily pass therethrough a direct current component of the high-frequency signal having a millimeter wave band. Thus, there is adopted a constitution that the band pass filter passes therethrough a signal having a frequency band necessary for transmission of a signal having a millimeter wave band, and a signal is transmitted between the semiconductor device and the outside. In this case, the band pass filter is separated into the two parts by the portion having the small capacity of the band pass filter, for example, the capacitor 13. Also, the semiconductor device 14 and the outside 15 are connected to each other by the part 11 and the remainder 12 of the band pass filter separated from each other. With the constitution as described above, the high-frequency signal having a millimeter wave band is inputted/outputted to/from the semiconductor device 14, which results in that an unnecessary signal having a band out of a given band can be cut off.

Figure 3:
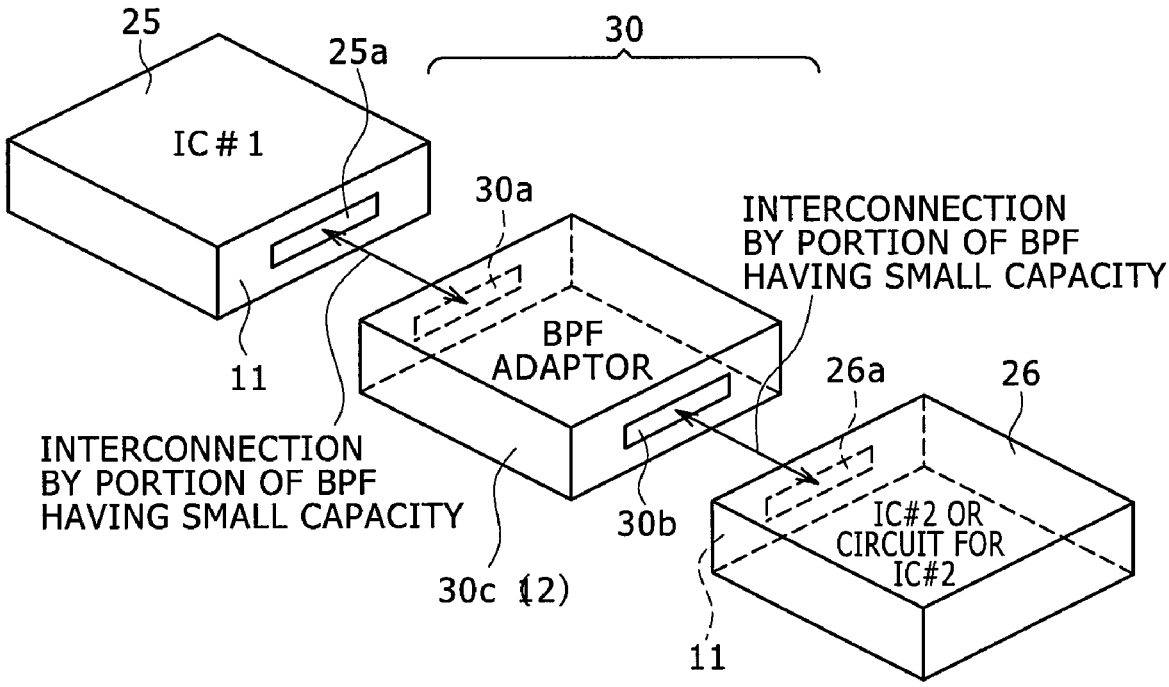
FIG. 3 is a schematic perspective view of a semiconductor device interconnecting unit for interconnecting two semiconductor devices according to another embodiment.

FIG. 3 is a schematic perspective view of a semiconductor device interconnecting unit 30 for interconnecting first and second semiconductor devices 25 and 26 to each other according to another embodiment. The semiconductor device interconnecting unit 30 includes first and third parts 11 and 11 of a band pass filter included in the first and second semiconductor devices 25 and 26, respectively, and a remainder 12 of the band pass filter included in an adaptor 30*c* for signal connection.

The first semiconductor device 25 and the adaptor 30*c* for signal connection are connected to each other by the first part 11 and the remainder 12 of the band pass filter similar to those shown in FIG. 1. In addition, the adaptor 30*c* for signal connection and the second semiconductor device 26 are connected to each other by the third part 11 and the remainder 12 of the band pass filter similar to those shown in FIG. 1.

More specifically, the semiconductor device interconnecting unit 30 is one for interconnecting at least the two semiconductor devices 25 and 26 to/from each of which the high-frequency signal having the millimeter wave band is inputted/outputted. Also, the semiconductor device interconnecting unit 30 includes the first part 11 of the band pass filter, the second part 12 of the band pass filter included in the adaptor 30*c* for signal connection, and the third part 11 of the band pass filter. Here, the first part 11 of the band pass filter passes therethrough the high-frequency signal having the millimeter wave band by an LC resonance circuit.

Also, the adjacent first and second parts 11 and 12, the adjacent second and third parts 12 and 11 are separated from each other by capacitive portions (capacitors), respectively. The first part 11 is provided inside the first semiconductor device 25, and the third part 11 is provided inside the second semiconductor device 26. Also, the second part 12 is included in the adaptor 30*c* for signal connection having input/output terminals 30*a* and 30*b* which face an input/output terminal 25*a* of the first part 11, and an input/output terminal 26*a* of the third part 11, respectively. Also, the second part 12 is provided outside each of the first and second semiconductor devices 25 and 26.

Figure 4:
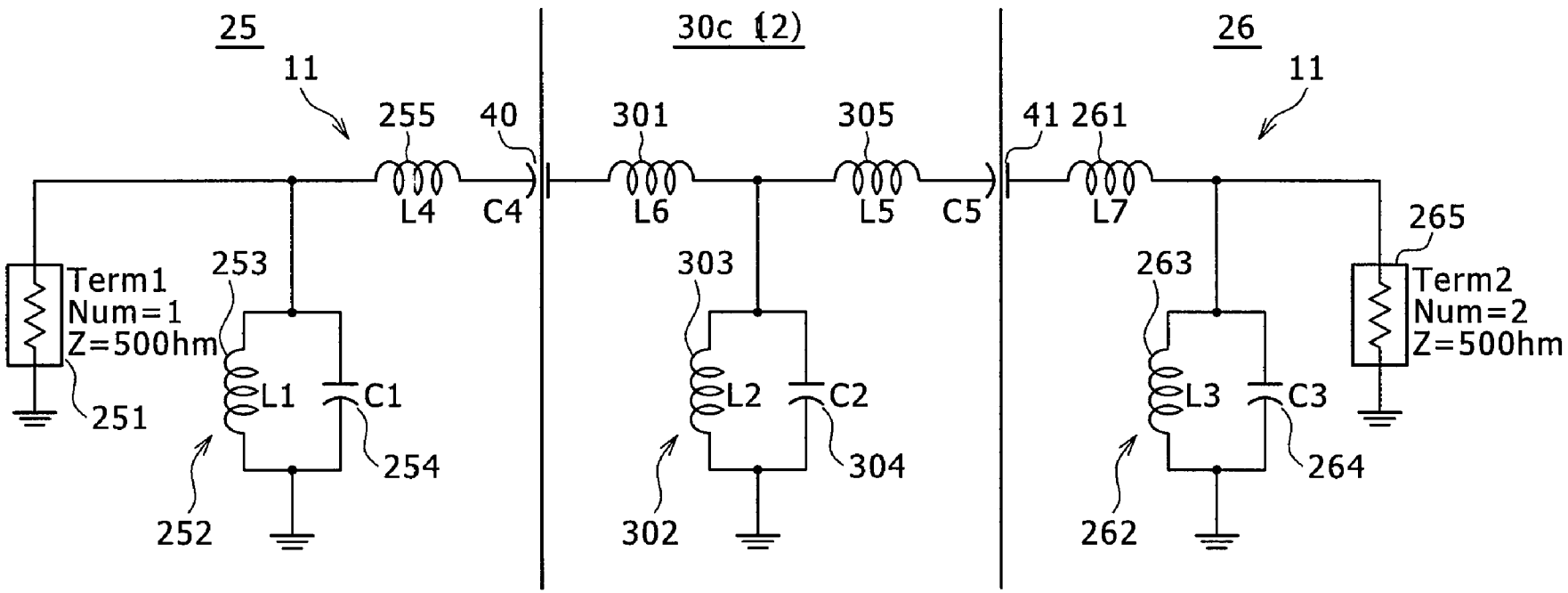
FIG. 4 is a circuit diagram of the semiconductor device interconnecting unit shown in FIG. 3.

FIG. 4 is a circuit diagram of the first and second semiconductor devices 25 and 26 interconnected to each other by the adaptor 30*c* for signal connection, and the adaptor 30*c* for signal connection. Here, the first and second semiconductor devices 25 and 26 and the adaptor 30*c* for signal connection constitute the semiconductor device interconnecting unit 30 shown in FIG. 3. The first and third built-in band pass portions 11 and 11 of the first and second semiconductor devices 25 and 26, and the adaptor 30*c* for signal connection constitute a band pass filter. In particular, FIG. 4 shows a circuit diagram of a Chebyshev type band pass filter (type 1 and n=5). This Chebyshev type band pass filter has a pass band from 58 GHz to 62 GHz.

In the first semiconductor device 25, a load 251 and a resonance circuit 252 which are connected in parallel with each other are connected in series with an inductor 255. The resonance circuit 252 includes an inductor 253 and a capacitor 254 connected in parallel with the inductor 253.

In the second semiconductor device 26, a load 265 and a resonance circuit 262 which are connected in parallel with each other are connected in series with an inductor 261. The resonance circuit 262 includes an inductor 263 and a capacitor 264 connected in parallel with the inductor 263.

The adaptor 30*c* for signal connection includes a resonance circuit 302 provided between an intermediate node between the inductors 301 and 305, and the earth. The resonance circuit 302 includes an inductor 303 and a capacitor 304 connected in parallel with each other.

The semiconductor device which manages the high-frequency signal having a millimeter wave band, for example, from 58 GHz to 62 GHz needs not to necessarily pass therethrough a direct current component. Thus, there is adopted a constitution that the band pass filter passes therethrough a signal having a frequency band necessary for transmission of a signal having a millimeter wave band, and a signal is transmitted between the semiconductor device and the outside. In this case, the band pass filter is separated into the three parts by the portions each having a small capacity, for example, the capacitors 40 and 41, and the first and second semiconductor devices 25 and 26 are connected to each other by the two parts 11 of the band pass filter thus separated, and the remainder 12 of the band pass filter. With the constitution as described above, the high-frequency signal is inputted/outputted to/from each of the semiconductor devices, which results in that the unnecessary signal having a band out of a given band can be cut off.

In FIG. 4, an inductance value and capacitance value of the inductor 253 and the capacitor 254 of the resonance circuit 252 on the first semiconductor device 25 side are designated with L1 and C1, respectively, and an inductance value of the inductor 255 on the first semiconductor device 25 side is designated with as L4. In addition, inductance values of the inductor 301 and the inductor 305 in the adaptor 30*c* for signal connection are designated with L6 and L5, respectively, and an inductance value and a capacitance value of the inductor 303 and the capacitor 304 of the resonance circuit 302 in the adaptor 30*c* for signal connection are designated with L2 and C2, respectively. Also, an inductance value of the inductor 261 on the second semiconductor device 26 side is designated with L7, and an inductance value and a capacitance value of the inductor 263 and the capacitor 264 of the resonance circuit 262 on the second semiconductor device 26 side are designated with L7 are set as L3 and C3, respectively. Moreover, capacitance values of the capacitors 40 and 41 are designated with C4 and C5, respectively.

Figure 5:
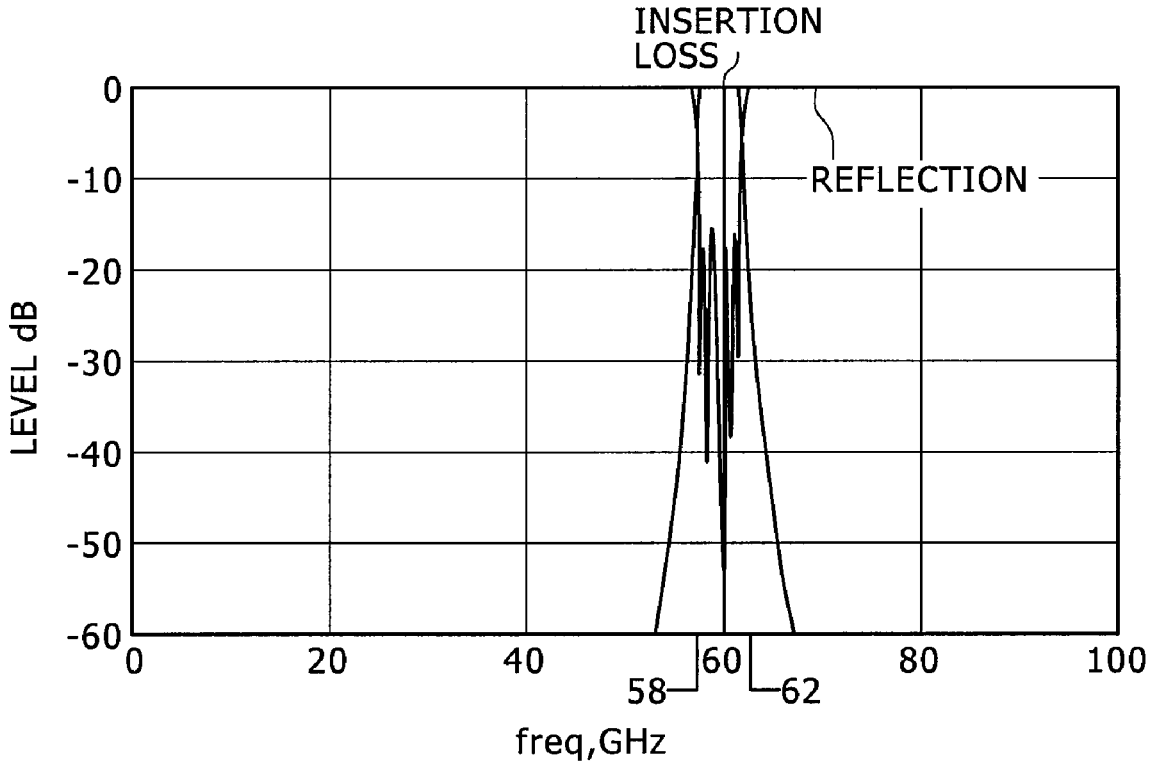
FIG. 5 is a graph showing interconnection characteristics of the semiconductor device interconnecting unit shown in FIG. 3.

FIG. 5 is a graph showing interconnection characteristics obtained when the first and second semiconductor devices 25 and 26 are interconnected to each other by using the circuit shown in FIG. 4. In the figure, an axis of ordinate represents a signal level (dB), and an axis of abscissa represents a frequency (GHz). Although an insertion loss and reflection are recognized in the graph shown in FIG. 5, when L1=7.71 pH, L2=4.48 pH, L3=7.71 pH, C1=913 fF, C2=1570 fF, and C3=913 fF, and also L4=273 pH, C4=2.58 fF, L5=L6=2457 pH, C5=2.58 fF and C7=273 pH in the circuit shown in FIG. 4, it is possible to realize the pass band from 58 GHz to 62 GHz.

Figure 6:
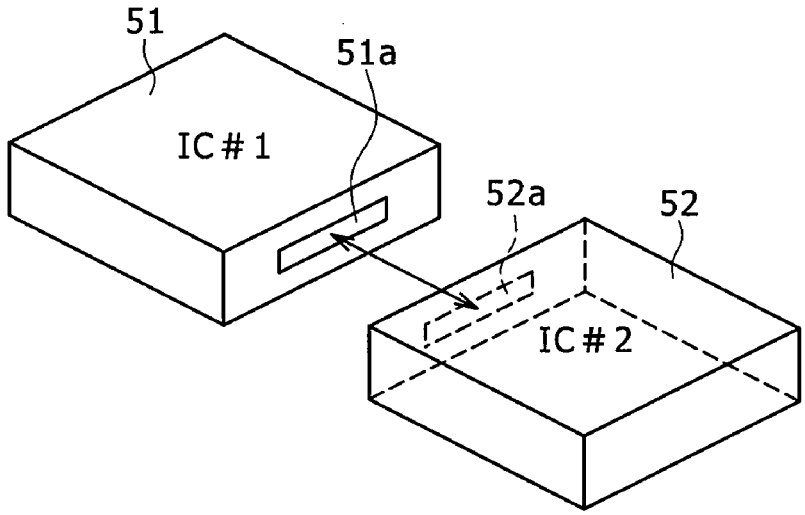
FIG. 6 is a schematic perspective view showing a constitution of a comparative example as a related art.
Figure 7:
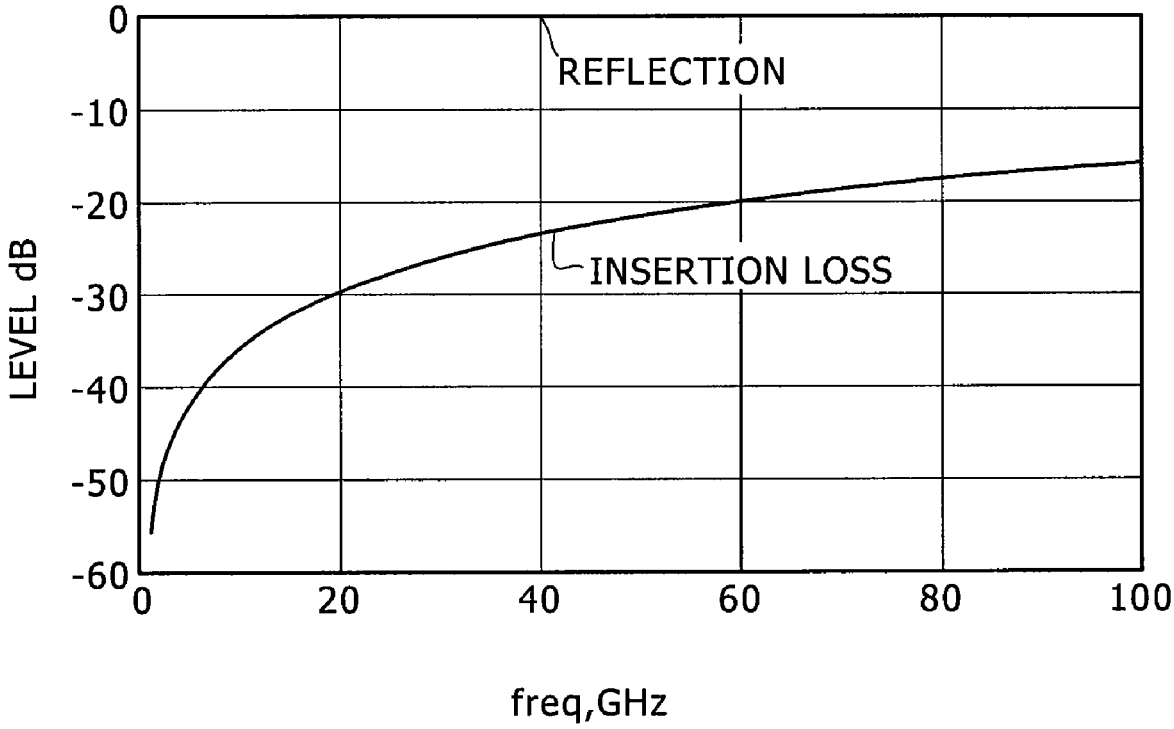
FIG. 7 is a graph showing capacitive interconnection characteristics of the comparative example in the related art.

FIG. 6 shows a comparative example in which a first semiconductor device 51 and a second semiconductor device 52 are simply interconnected to each other through interchip-interconnection by using a capacitor having the same capacity as that of each of the capacitors 13 in FIG. 2, and 40 and 41 in FIG. 4. FIG. 7 shows a capacitive interconnection characteristics diagram of the comparative example shown in FIG. 6. As can be seen from FIG. 7, it is confirmed that although the insertion loss and the reflection are recognized, the interconnection is hardly carried out when the first and second semiconductor devices (chips) 51 and 52 are simply interconnected through the interchip-interconnection by using the same capacity.

Figure 8:
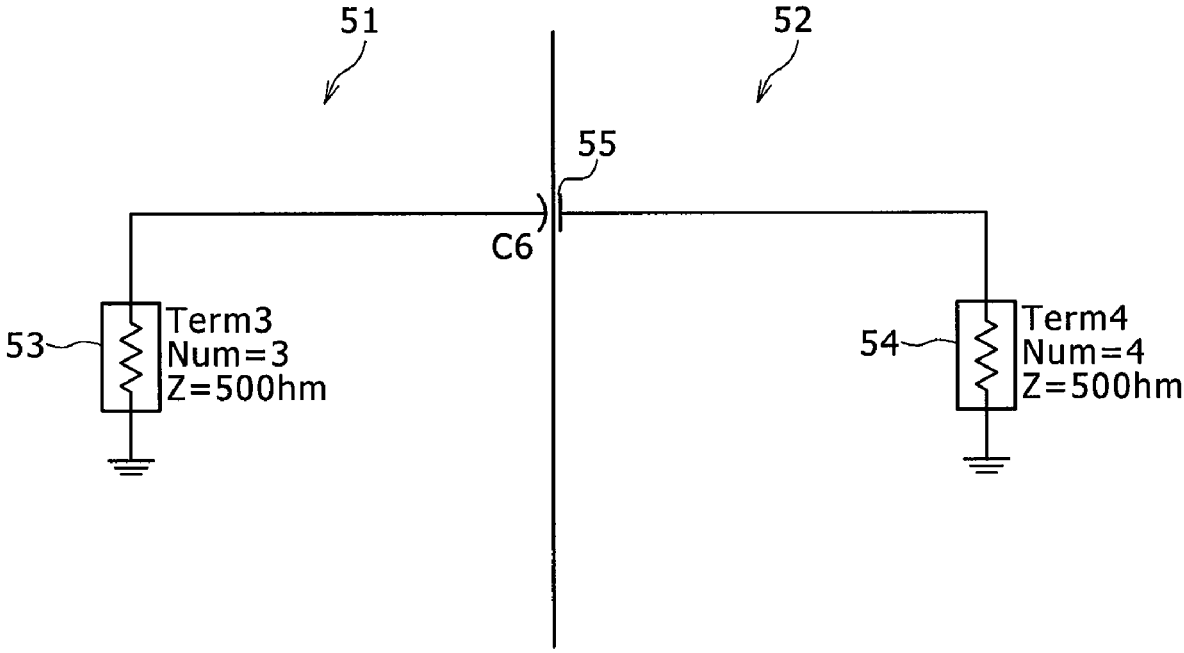
FIG. 8 is a circuit diagram of the comparative example having capacitive interconnection in the related art.

FIG. 8 shows a circuit diagram when the interchip-interconnection is simply carried out by using the same capacity. The first semiconductor device 51 having a load 53, and the second semiconductor device 52 having a load 54 are simply interconnected to each other through the interchip-interconnection by a capacitor 55.

A large capacity is necessary for the capacitive interconnection in such a comparative example. As has been described, when the interchip-interconnection is simply carried out by using the same capacity, the interconnection is hardly obtained.

Next, a description will now be given with respect to an example in which the semiconductor device interconnecting unit according to an embodiment is applied to a receiver. That is to say, in this example, the semiconductor device interconnecting device according to an embodiment is applied to a high-frequency module in which a semiconductor device to/from which a high-frequency signal having a millimeter wave band is inputted/outputted is installed. In this case, the semiconductor device includes a part of a band pass filter for passing therethrough the high-frequency signal having the millimeter wave band by using an LC resonance circuit. Also, the part of the band pass filter is interconnected to a remainder of the band pass filter provided outside the semiconductor device by a capacitive portion.

Figure 9:
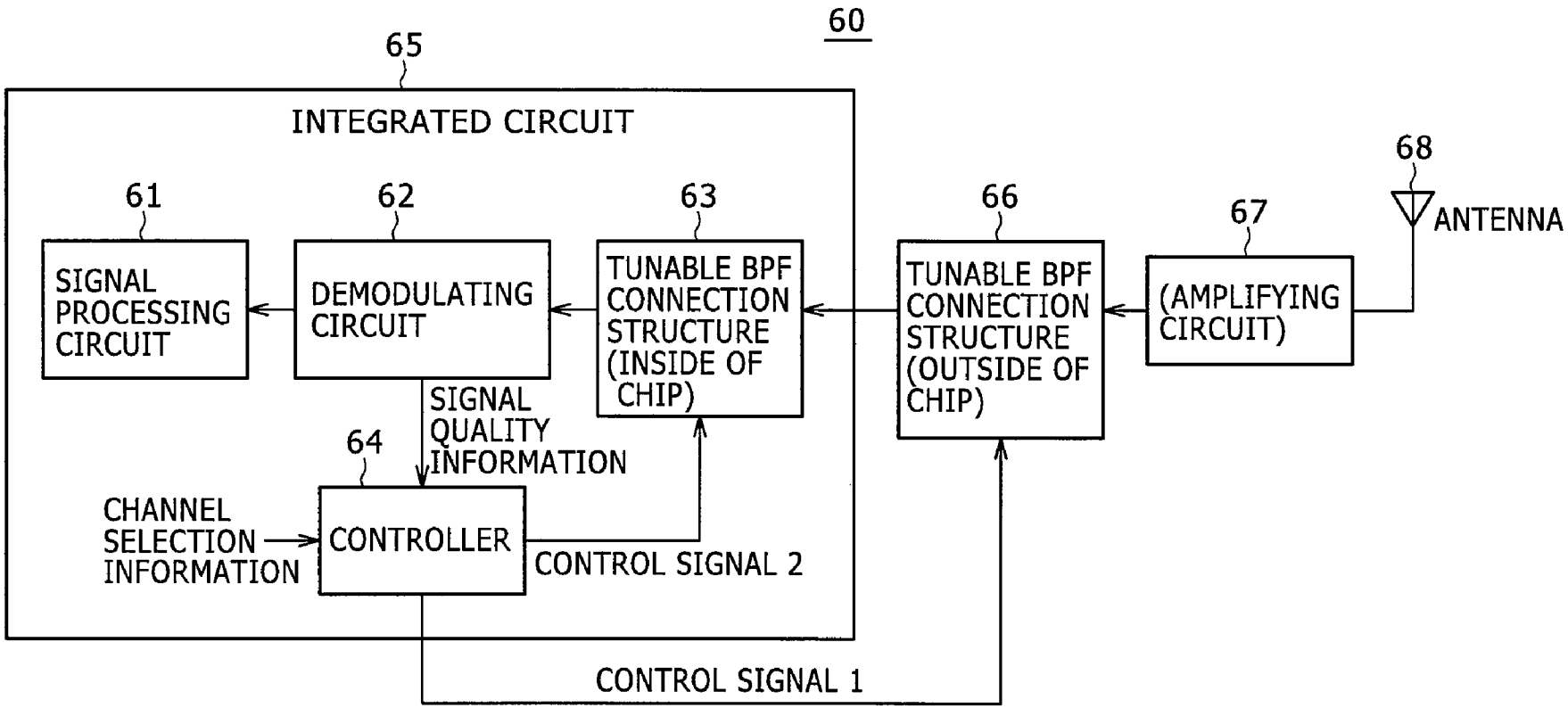
FIG. 9 is a block diagram of an example in which tunable BPF interconnection is applied to a receiver.

FIG. 9 shows an example in which a tunable BPF connection structure is used in a receiver. After a signal is received at an antenna 68 and is amplified by an amplifying circuit 67, the resulting signal is supplied to a tunable BPF connection structure portion (provided outside a chip) 66.

The tunable BPF connection structure portion (outside of chip) 66 is provided outside a semiconductor chip 65 because it is one of two parts into which a BPF for passing therethrough a high-frequency signal having a desired frequency is separated by a capacitive portion used to form a resonance structure.

A tunable BPF connection structure portion (provided inside the chip) 63 is the remainder obtained through the separation by the capacitive portion for formation of the above-mentioned resonance structure, and is provided inside the semiconductor chip 65.

The high-frequency signal having the desired frequency which is obtained through filtering in the BPF is outputted through an output terminal of the tunable BPF connection structure portion (inside of chip) 63. This high-frequency signal is supplied to a demodulating circuit 62.

The demodulating circuit 62 subjects the high-frequency signal having the desired frequency to demodulation processing corresponding to modulation processing on a transmitter side, and supplies the resulting high-frequency signal to a signal processing circuit 61 in a subsequent stage of the demodulating circuit 62. In addition, the demodulating circuit 62 generates signal quality information, and supplies the signal quality information to a controller 64.

The controller 64 generates tuner channel selection control signals 1 and 2 in accordance with channel selection information generated in accordance with a manipulation or the like for the receiver made by a user. Also, the controller 64 supplies the tuner broadcasting channel selection control signals 1 and 2 to the tunable BPF connection structure portion (outside of chip) 66 and the tunable BPF connection structure portion (inside of chip) 63, respectively.

When being built in the chip, the BPF structure uses a large area within the chip. This is a problem. In addition, it is difficult to form a structure having a high Q on a silicon substrate. This is another problem. At a high frequency, for example, contained in a millimeter wave band, a signal is reflected by a capacitive component of a pad for an input/output terminal, an inductive component of a bonding, or the like. On the other hand, a BPF often uses a resonance structure. This resonance structure is skillfully utilized, and the capacitive component or the like of the pad is utilized as one of constituent components of the BPF, thereby enabling a millimeter wave band pass type connection to be realized.

In order to utilize the capacity or the like of the pad for the BPF, it is necessary to increase a precision of the capacitive value thereof. Actually, the capacitive value disperses due to the dispersion caused in the phase of the manufacture. In order to solve this problem, for example, the signal quality information is read out from the circuit, such as the demodulating circuit 62 shown in FIG. 9, which can judge the quality of the signal from the BPF connection structure. Also, the controller 64 generates the tuner channel selection control signals 1 and 2 in accordance with the signal quality information thus read out, and sends the tuner channel selection control signals 2 and 1 to the BPF connection structure 63 provided inside the semiconductor chip 65, and the BPF connection structure 66 provided outside the semiconductor chip 65, respectively. As a result, the signal can be optimized and the dispersion caused by the manufacturing process, the temperature change or the like can be corrected. Here, the connection made at a much lower frequency than that in the tunable BPF connection structure is sufficient for the connection of the tuner broadcasting channel selection control signals 1 and 2.

Figure 10:
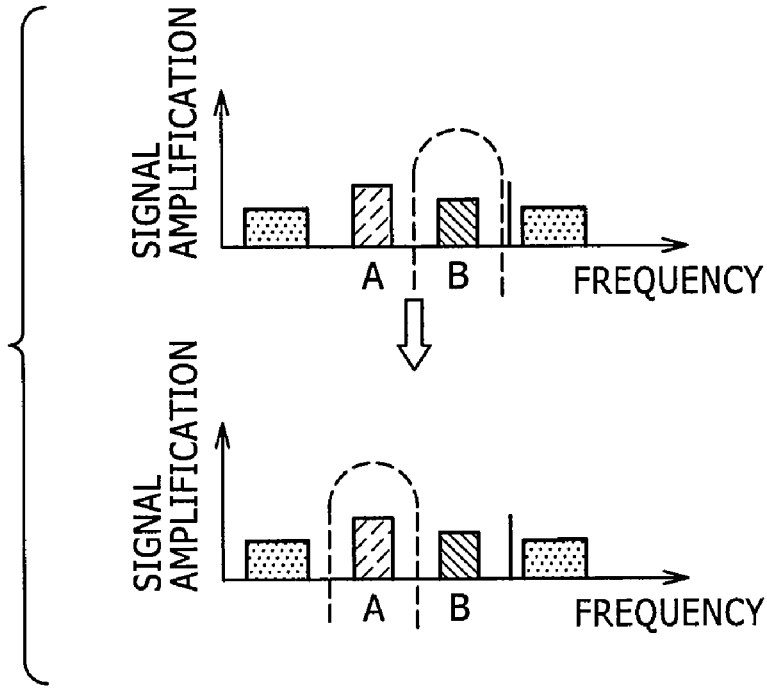
FIG. 10 is a graphical representation explaining an example in which a band pass structure used in the embodiment is utilized for an operation for selecting a broadcasting channel.

In addition, broadcasting channel selection information is sent to the controller 64, which results in that as shown in FIG. 10, it is also possible to change the channel frequency from a channel frequency B over to a channel frequency A.

Figure 11:
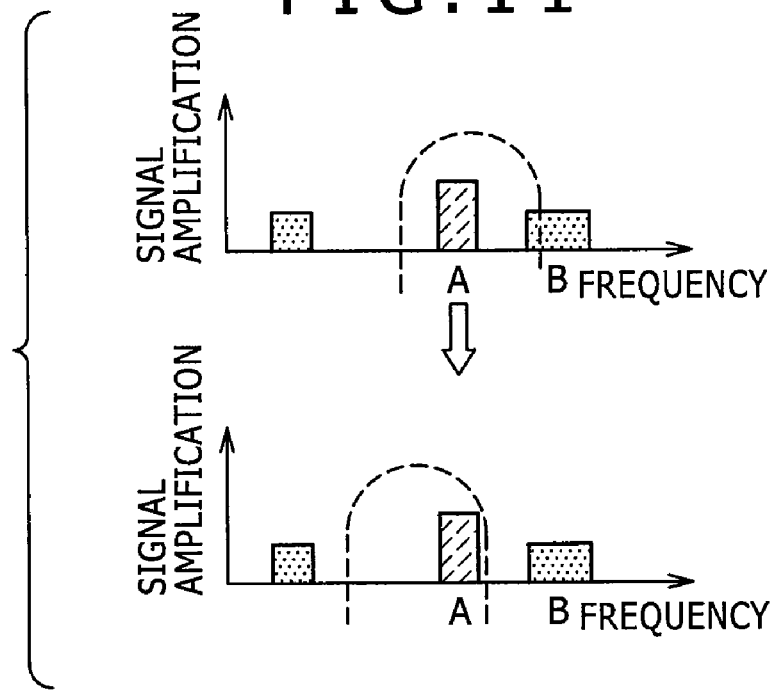
FIG. 11 is a graphical representation explaining an example in which the band pass structure used in an embodiment is utilized for removal of an interfering wave.

In addition, the embodiment can be utilized for such an application that a central frequency of the filter is shifted in order to suppress an influence of an interfering wave as shown in FIG. 11.

It is also a large merit that the using of the band pass type connection as the connection between the semiconductor chip and the outside makes it possible to suppress the interfering noises from other frequencies.

Figure 12:
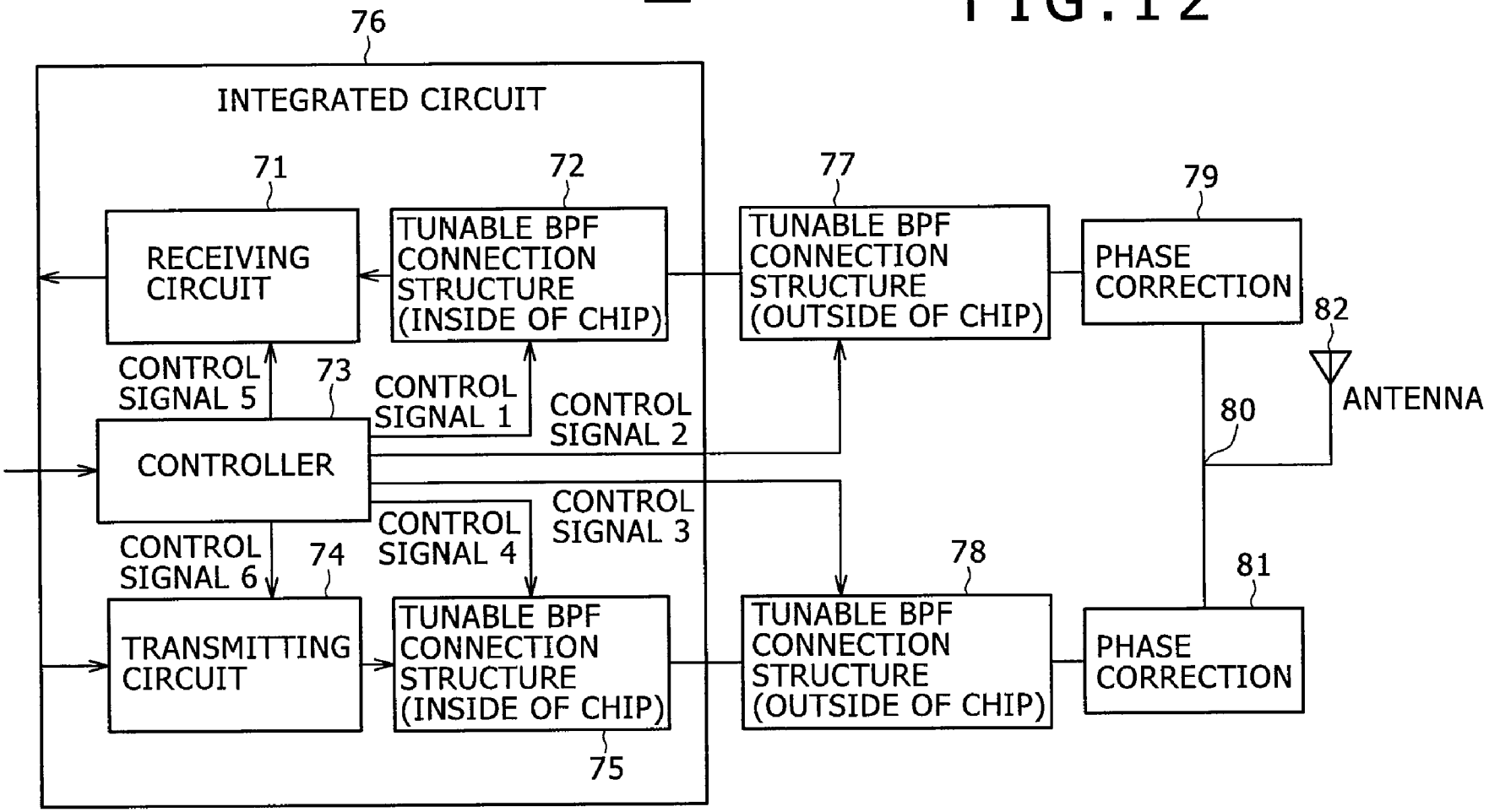
FIG. 12 is a block diagram of a constitution of an example in which a combination of two interconnection structures is used in the form of a switch for transmission/reception.

Next, a description will now be given with respect to an example in which the semiconductor device intersecting unit according to the embodiment is used in switching of a transmitter-receiver. FIG. 12 is a block diagram showing a constitution in which a combination of the two connection structures is used in the form of a switch for transmission/reception.

A reception side of the transmitter-receiver receives a signal at an antenna 82, and supplies the signal to a phase correcting portion 79 through a branch point 80. After correcting a phase of the received signal, the phase correcting portion 79 supplies the resulting signal to a tunable BPF connection structure portion (provided outside a chip) 77. The tunable BPF connection structure portion (outside of chip) 77 is provided outside a semiconductor chip 76 because it is one of two parts into which a BPF for passing therethrough a high frequency signal having a desired frequency is separated by a capacitive portion for formation of a resonance structure.

The remainder of the two parts into which the BPF is separated by the capacitive portion for formation of the resonance structure, that is, a tunable BPF connection structure portion (provided outside the chip) 72 is provided inside the semiconductor chip 76.

A high-frequency signal having a desired frequency which is obtained through filtering in the BPF is outputted through an output terminal of the tunable BPF connection structure portion (outside of chip) 72. The high-frequency signal having a desired frequency is supplied to a receiving circuit 71.

On the other hand, a transmission side of the transmitter-receiver includes a transmitting circuit 74, a tunable BPF connection structure portion (provided inside the chip) 75, a tunable BPF connection structure portion (provided outside the chip) 78, and a phase correcting portion 81. Here, the transmitting circuit 74 processes an input signal into one for transmission. The tunable BPF connection structure portion (inside of chip) 75 is one of two parts into which a BPF for passing therethrough a high frequency signal having a desired frequency is separated by a capacitive portion, and receives as its input the transmission signal obtained through the transmission processing in the transmitting circuit 74. The tunable BPF connection structure portion (outside of chip) 78 constitutes together with the tunable BPF connection structure portion (inside of chip) 75 the BPF. Also, the phase correcting portion 81 corrects a phase of the high-frequency signal which is obtained through the filtering for the band pass in the tunable BPF connection structure portion (outside of chip) 78.

The receiving circuit 71 on the reception side, and the transmitting circuit 74 on the transmission side are connected to each other through the controller 73. In addition, the controller 73 is connected to each of the tunable BPF connection structure portion (inside of chip) 72 and the tunable BPF connection structure portion (outside of chip) 77 on the reception side. Also, the controller 73 supplies control signals 1 and 2 to the tunable BPF connection structure portion (inside of chip) 72 and the tunable BPF connection structure portion (outside of chip) 77, respectively. Also, the controller 73 is connected to each of the tunable BPF connection structure portion (inside of chip) 75 and the tunable BPF connection structure portion (outside of chip) 78 on the transmission side, and supplies control signals 4 and 3 to the tunable BPF connection structure portion (inside of chip) 75 and the tunable BPF connection structure portion (outside of chip) 78, respectively.

When an incoming signal is received, the controller 73 performs the control by using the control signals 1 to 4 so that each of the tunable BPF connection structure portion 72 and the tunable BPF connection structure portion 77 has the pass band, while each of the tunable BPF connection structure portion 75 and the tunable BPF connection structure portion 78 has a non-pass band. The incoming signal is reflected by the tunable BPF connection structure portion 75 and the tunable BPF connection structure portion 78 each having the non-pass band, and the phase correcting portions 79 and 81 are designed so that an impedance when the tunable BPF connection structure portion 75 side is viewed from the branch point 80 becomes infinite. In this case, the satisfactory switch free from the loss can be realized in the millimeter wave band. When a transmission signal is transmitted, the controller 73 performs the control by using the control signals 1 to 4 so that each of the tunable BPF connection structure portion 72 and the tunable BPF connection structure portion 77 has the non-pass band, while each of the tunable BPF connection structure portion 75 and the tunable BPF connection structure portion 78 has the pass band, thereby causing the transmission signal to flow to the antenna 82. As a result, the isolation between the receiving circuit 72 and the transmitting circuit 74 is realized.

It is not easy to realize the satisfactory switch in the millimeter wave band on the silicon substrate. Thus, the satisfactory switch is realized in the millimeter wave band by utilizing the input/output structure necessary for connection to the chip. Since the operation of the switch is not mechanical, but depends on the electrical control, the high-speed switch can be realized.

In addition, a combination with the control structure makes it possible to correct the dispersion or the like of the semiconductors and the manufacturing processes.

Figure 13:
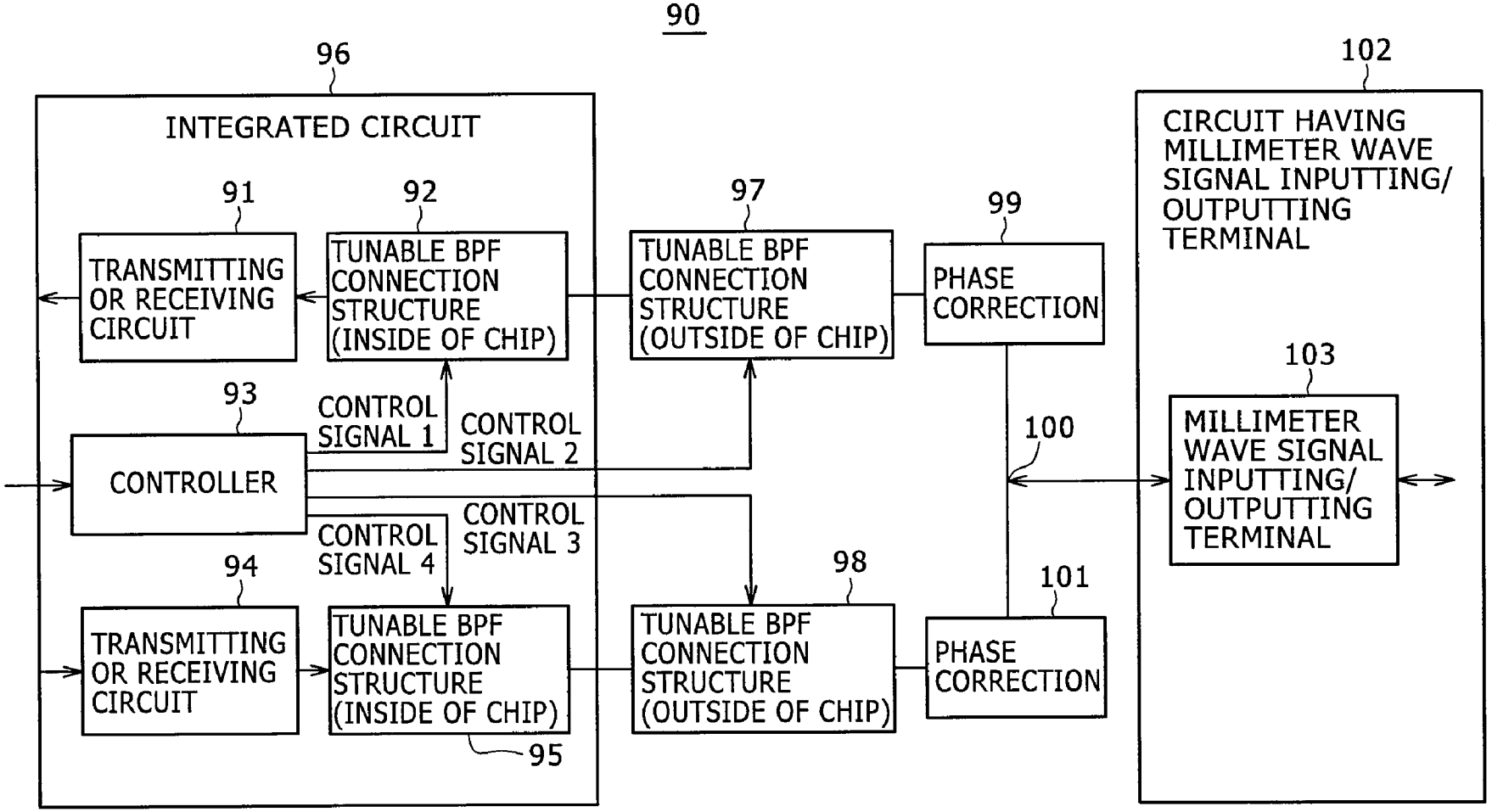
FIG. 13 is a block diagram of a constitution of an example in which the semiconductor device interconnecting unit of the embodiment is utilized for connection between two circuits.

Next, a description will now be given with respect to an example in which the semiconductor device interconnecting unit according to the embodiment is utilized for connection between circuits. As shown in FIG. 13, a high-frequency module 90 is described in this example. In the high-frequency module 90, a high-frequency signal having a millimeter wave band is transmitted between an integrated circuit 96 including transmitting or receiving circuits 91 and 94 of two systems, and a circuit 102 having a terminal 103 through which a millimeter wave signal is inputted/outputted. That is to say, this example is such that a switch, for transmission/reception, having a combination of two connection structures is utilized for connection between the two circuits 96 and 102.

The integrated circuit 96 includes a first system having a transmitting or receipting circuit 91, and a tunable BPF connection structure portion (provided inside a chip) 92, a second system having a transmitting or receiving circuit 94, and a tunable BPF connection structure portion (provided inside a chip) 95, and a controller 93. Here, the tunable BPF connection structure portion (inside of chip) 92 is one of two parts into which a BPF for passing therethrough a high-frequency signal having a desired frequency is separated by a capacitive portion for formation of a resonance structure. Also, the tunable BPF connection structure portion (inside of chip) 95 is one of two parts into which a BPF for passing therethrough a high-frequency signal having a desired frequency is separated by a capacitive portion for formation of a resonance structure similarly to the tunable BPF connection structure portion (inside of chip) 92. The controller 93 is connected to each of the tunable BPF connection structure portion (inside of chip) 92, and a tunable BPF connection structure portion (provided outside the chip) 97, and supplies control signals 1 and 2 to the tunable BPF connection structure portion (inside of chip) 92 and the tunable BPF connection structure portion (outside of the chip) 97, respectively. Also, the controller 93 is connected to each of the tunable BPF connection structure portion (inside of chip) 95 and a tunable BPF connection structure portion (provided outside the chip) 98, and supplies control signals 4 and 3 to the tunable BPF connection structure portion (inside of chip) 95 and the tunable BPF connection structure portion (outside of the chip) 98, respectively.

The tunable BPF connection structure portion (outside of the chip) 97, and the tunable BPF connection structure portion (outside of chip) 98 are provided outside the semiconductor integrated circuit 96. Here, the tunable BPF connection structure portion (outside of the chip) 97 is connected to the tunable BPF connection structure portion (inside of chip) 92 provided inside the semiconductor integrated circuit 96. Also, the tunable BPF connection structure portion (outside of the chip) 98 is connected to the tunable BPF connection structure portion (inside of chip) 95. In addition, the high-frequency module 90 includes a phase correcting portion 99, and a phase correcting portion 101. Here, the phase correcting portion 99 corrects a phase of the high-frequency signal which is obtained through the filtering for the band pass in the tunable BPF connection structure portion (outside of the chip) 97, and the phase correcting portion 101 corrects a phase of the high-frequency signal which is obtained through the filtering for the band pass in the tunable BPF connection structure portion (outside of the chip) 98.

In the circuit 102 having the millimeter wave signal inputting/outputting terminal 103, the millimeter wave signal inputting/outputting terminal 103 is connected to each of the phase correcting portion 99 and the phase correcting portion 101.

The tunable BPF connection structure can also be used in the millimeter wave signal inputting/outputting terminal 103. Although in this example, the two connection structures are provided on the semiconductor integrated circuit 96 side, the number of connection structures can be increased.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A semiconductor device interconnecting unit for inputting/outputting a high-frequency signal having a millimeter wave band to/from a semiconductor device, the semiconductor device interconnecting unit comprising:

a part of a band pass filter being provided inside said semiconductor device, said part of said band pass filter being configured to pass therethrough the high-frequency signal having a millimeter wave band by using a first LC resonance circuit, said first LC resonance circuit including a first inductor connected in parallel with a first capacitor; and a remainder of said band pass filter being provided outside said semiconductor device, said remainder of said band pass filter including a second LC resonance circuit, said second LC resonance circuit including a second inductor connected in parallel with a second capacitor;

wherein said part of said band pass filter and said remainder of said band pass filter are separated from each other by a capacitive portion.

2. A semiconductor device interconnecting unit for interconnecting a first semiconductor device to a second semiconductor device, wherein a high-frequency signal having a millimeter wave band is inputted/outputted to/from said first semiconductor device and said second semiconductor device, said semiconductor device interconnecting unit comprising:

a first part of a band pass filter being provided inside said first semiconductor device, said first part of the band pass filter being configured to pass therethrough the high-frequency signal having a millimeter wave band by using a first LC resonance circuit, said first LC resonance circuit including a first inductor connected in parallel with a first capacitor, said first part of the band pass filter having a first input/output terminal;

a second part of said band pass filter being provided outside each of said first and second semiconductor devices, said second part of the band pass filter including a second LC resonance circuit, said second LC resonance circuit including a second inductor connected in parallel with a second capacitor, said second part of said band pass filter being adjacent to the first part of the band pass filter, said second part of the band pass filter having a second input/output terminal and a third input/output terminal; and a third part of said band pass filter being provided inside said second semiconductor device, said third part of the band pass filter being including a third LC resonance circuit, said third LC resonance circuit including a third inductor connected in parallel with a third capacitor, said third part of said band pass filter being adjacent to the second part of the band pass filter, said third part of the band pass filter having a fourth input/output terminal;

wherein:

(a) said first part of the band pass filter and the second part of the band pass filter are separated from each other by a first capacitive portion provided between said first part of the band pass filter and second part of the band pass filter;

(b) said second part of the band pass filter and the third part of the band pass filter are separated from each other by a second capacitive portion provided between said second part of the band pass filter and said third part of the band pass filter, (c) said second input/output terminal faces said first input/output terminal; and (d) said third input/output terminal faces said fourth input/output terminal.

3. A semiconductor device, wherein a high-frequency signal having a millimeter wave band is inputted/outputted to/from said semiconductor device, said semiconductor device comprising:

a part of a band pass filter configured to pass therethrough the high-frequency signal having a millimeter wave band by using a first LC resonance circuit, said first LC resonance circuit including a first inductor connected to a first capacitor, said part of the band pass filter being connected to a remainder of said band pass filter provided outside said semiconductor device by a capacitive portion, said remainder of the band pass filter including a second LC resonance circuit, said second LC resonance circuit including a second inductor connected in parallel with said second capacitor.

4. A high-frequency module comprising:

a semiconductor device to/from which a high-frequency signal having a millimeter wave band is inputted/outputted, said semiconductor device being installed together with other elements or devices, said semiconductor device including first part of a band pass filter for passing therethrough the high-frequency signal having the millimeter wave band by using a first LC resonance circuit, said first LC resonance circuit including a first inductor connected in parallel with a first capacitor, said part of said band pass filter being connected to a remainder of said band pass filter provided outside said semiconductor device by a capacitive portion, said remainder including a second LC resonance circuit, said second LC resonance circuit including a second inductor connected in parallel with a second capacitor.

5. A semiconductor device interconnecting method of inputting/outputting a high-frequency signal having a millimeter wave band to/from a semiconductor device, said semiconductor device interconnecting method comprising:

interconnecting, by a capacitive portion, a part of a band pass filter and a remainder of said band pass filter separated from said part of said band pass filter by said capacitive portion to each other by said capacitive portion, said part of said band pass filter passing therethrough the high-frequency signal having the millimeter wave band by using a first LC resonance circuit, said first LC resonance circuit including a first inductor connected in parallel with a second capacitor, said part of the band pass filter being provided inside a semiconductor device, said remainder of the band pass filter including a second LC resonance circuit, said second LC resonance circuit including a second inductor connected in parallel with a second capacitor, said remainder of the band pass filter being provided outside the semiconductor device.

* * * * *